US010465536B2

(12) United States Patent
Hewitt et al.

(10) Patent No.: US 10,465,536 B2
(45) Date of Patent: Nov. 5, 2019

(54) GAS TURBINE ENGINE COMPONENT WITH AN ABRASIVE COATING

(71) Applicant: ROLLS-ROYCE plc, London (GB)

(72) Inventors: Andrew Hewitt, Derby (GB); Matthew Hancock, Derby (GB)

(73) Assignee: ROLLS-ROYCE plc, London (GB)

( * ) Notice: Subject to any disclaimer, the term of this patent is extended or adjusted under 35 U.S.C. 154(b) by 503 days.

(21) Appl. No.: 15/136,308

(22) Filed: Apr. 22, 2016

(65) Prior Publication Data

US 2016/0341051 A1 Nov. 24, 2016

(30) Foreign Application Priority Data

May 20, 2015 (GB) ..... 1508637.4

(51) Int. Cl.

| | |
|---|---|
| ***F01D 5/28*** | (2006.01) |
| ***F01D 5/20*** | (2006.01) |
| ***F01D 11/12*** | (2006.01) |
| ***F01D 5/14*** | (2006.01) |

(52) U.S. Cl.

CPC ..... *F01D 5/288* (2013.01); *F01D 5/147* (2013.01); *F01D 5/20* (2013.01); *F01D 11/122* (2013.01); *F05D 2220/32* (2013.01); *F05D 2230/90* (2013.01); *F05D 2240/307* (2013.01); *F05D 2300/171* (2013.01); *F05D 2300/174* (2013.01); *F05D 2300/175* (2013.01); *F05D 2300/177* (2013.01); *F05D 2300/2282* (2013.01); *F05D 2300/6032* (2013.01)

(58) Field of Classification Search

CPC ..... F01D 5/20

See application file for complete search history.

(56) References Cited

U.S. PATENT DOCUMENTS 1,061,206 A * 5/1913 Tesla ..... F04D 19/04 415/9
4,227,703 A 10/1980 Stalker et al.
4,689,242 A 8/1987 Pike
(Continued)

FOREIGN PATENT DOCUMENTS

EP 0273852 A2 7/1988
EP 0484115 A1 5/1992
(Continued)

OTHER PUBLICATIONS

Ameri et. al., Effect of Squealer Tip on Rotor Heat Transfer and Efficiency, ASME, Journal of Turbomachinery, vol. 120 No. 4, Oct. 1998, pp. 753-759 (provided by applicant on Mar. 14, 2019) (Year: 1998).*

(Continued)

*Primary Examiner* — Igor Kershteyn
*Assistant Examiner* — John S Hunter, Jr.
(74) *Attorney, Agent, or Firm* — Oliff PLC

(57) ABSTRACT

A gas turbine engine component includes a rotor blade having a squealer tip comprising a projecting lip, the rotor blade further having a raised rim running along both edges of each projecting kip of the squealer tip, and an abrasive coating formed of hard particles embedded in a retaining matrix covering a tip region of the rotor blade within an area bounded by the raised rim. The raised rim has a height of between 50% and 75% of a mean diameter of the hard particles.

8 Claims, 4 Drawing Sheets

(56) References Cited

U.S. PATENT DOCUMENTS

| | | | | |
|---|---|---|---|---|
| 7,473,072 | B2 * | 1/2009 | Malak | C23C 28/00 415/173.4 |
| 7,510,370 | B2 * | 3/2009 | Strangman | C23C 26/02 415/173.4 |
| 7,537,809 | B2 * | 5/2009 | Ochiai | C23C 26/00 219/69.15 |
| 2008/0166225 | A1 | 7/2008 | Strangman et al. | |
| 2012/0051934 | A1 | 3/2012 | Allen | |

FOREIGN PATENT DOCUMENTS

| | | | |
|---|---|---|---|
| EP | 1365107 | A1 | 11/2003 |
| EP | 2573326 | A1 | 3/2013 |
| GB | 2075129 | A | 11/1981 |

OTHER PUBLICATIONS

Nov. 20, 2015 Search Report issued in British Patent Application No. 1508637.4.

Oct. 12, 2016 Search Report issued in European Patent Application No. 16166361.

Ameri et al.; "Effect of Squealer Tip on Rotor Heat Transfer and Efficiency;" Journal of Turbomachinery; Oct. 1998; vol. 120; pp. 753-759.

Jan. 24, 2018 Office Action issued in European Patent Application No. 16166361.2.

* cited by examiner

GAS TURBINE ENGINE COMPONENT WITH AN ABRASIVE COATING

FIELD OF THE INVENTION

The present invention relates to a gas turbine engine component with an abrasive coating.

BACKGROUND

Gas turbine engines have turbine rotor blades which rotate relative to a surrounding casing. To reduce heat generation, protect the blade and to form a seal between the blade and the casing, an abrasive coating may be attached to the blade tip. For example, FIG. 1*a* shows a smooth tipped turbine blade 31 with an abrasive coating 33, and FIG. 1*b* a cross section through the blade and coating. The abrasive coating comprises hard particles 35 embedded in a retaining matrix 37. When the blade is installed in a turbine and rotates, the hard particles abrade the softer material of the surrounding casing such that the blade forms a groove in the casing surface, providing a tight clearance and reducing friction between the blade and surrounding casing.

When attaching the abrasive coating, the hard particles may be tacked to the blade tip to hold them in place before the matrix is applied. Near to the edge of the blade tip, these tacked hard particles may drop off. This is particularly problematic when an abrasive coating is applied to a narrow section. For example, FIG. 2*a* shows a squealer tipped turbine blade 31 with an abrasive coating 33, and FIG. 2*b* shows a cross section through the blade and coating. The abrasive coating, containing the hard particles 35 and the retaining matrix 37, is attached to the narrow projecting lips 38 of the squealer tip. Due to their location close to the edges of the lips, hard particles may fall off. This may result in the abrasive coating having a reduced number of hard particles, decreasing the effectiveness of the coating.

A further problem arises if hard particles located at an edge encourage matrix material to be laid down overhanging the edge. Such overhangs can increase aerodynamic losses and may interfere with blade film cooling in the adjacent aerofoil surface.

Moreover, the abrasive coating on both the smooth and the squealer tipped blades is generally attached to a smooth surface. At elevated temperatures under near plastic conditions, the strength of the coating or the strength of the attachment between the coating and smooth surface may be insufficient to prevent the coating from being smeared off.

SUMMARY

The present invention aims to provide a gas turbine engine component with an abrasive coating which can reduce aerodynamic loses, decrease interference with component cooling systems, and improve the attachment of the coating to the component.

Accordingly, in a first aspect, the present invention provides a gas turbine engine component having:

- a raised rim located along one or more edges of a tip region of the component, and
- an abrasive coating formed of hard particles embedded in a retaining matrix covering the tip region within an area bounded by the raised rim the raised rim having a depth of between 50% and 75% of the mean diameter of the abrasive particles.

In a second aspect, the present invention provides a gas turbine engine having a component according to any one of the previous claims.

Optional features of the invention will now be set out. These are applicable singly or in any combination with any aspect of the invention.

The hard particles may be cubic boron nitride particles.

The matrix may be nickel, cobalt, iron or an alloy of any one or more thereof.

The hard particles may project beyond the raised rim, such that, in use, the hard particles abrade a runner surface of an adjacent component.

The component may be made of a nickel-based superalloy, steel or titanium-based alloy.

The retaining matrix may be electroplated.

The component may be a rotor blade. For example, the component may be a turbine blade, a compressor blade or a fan blade. The hard particles can then project radially beyond the raised rim, such that, in use, the hard particles abrade a runner surface of a casing surrounding the rotor blade. The blade may be squealer tipped or smooth tipped.

The component may have one or more seal fins, the or each seal fin having the raised rim and the abrasive coating at a tip region thereof. The one or more seal fins may form part of a labyrinth seal.

The raised rim may be produced by casting, electro-discharge machining, milling or additive layer manufacture. For example, the rim may be produced by laser cladding.

The raised rim may have a height of approximately 0.15 mm. The hard particles may have a mean diameter of between 0.18 and 0.25 mm.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

Figure 1A:
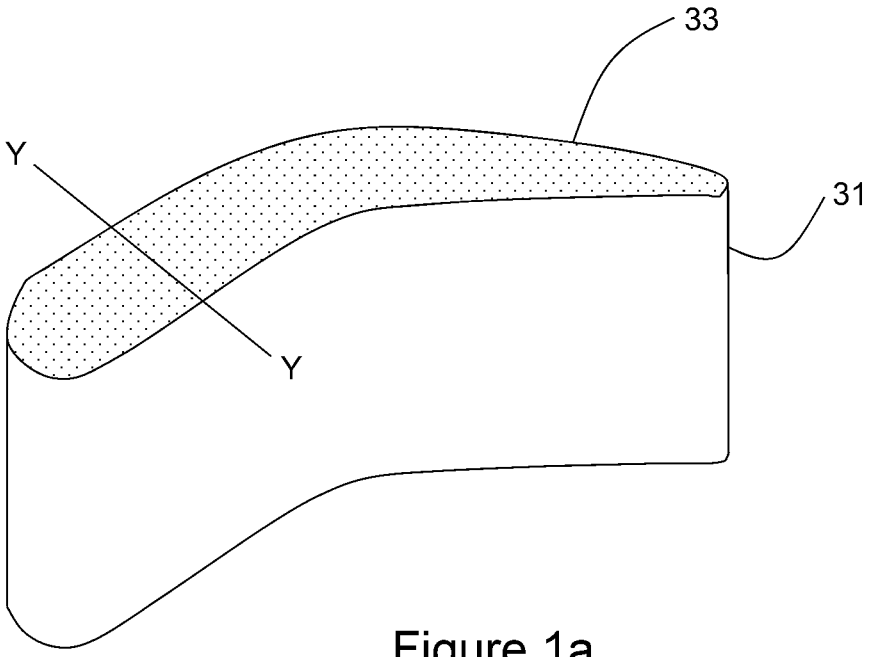
Figure 1a PRIOR ART
FIG. 1*a* shows schematically a smooth tipped turbine blade with an abrasive coating and FIG. 1*b* shows schematically a cross section on Y-Y through the blade and coating.
Figure 1B:
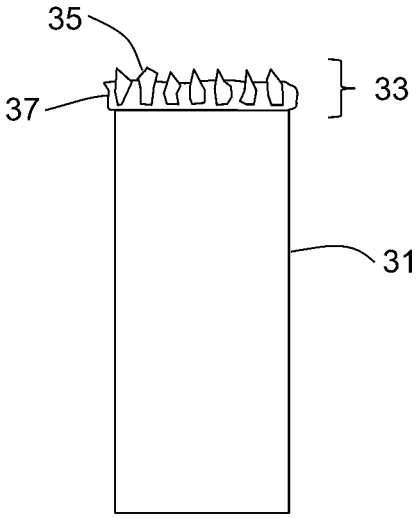
Figure 1b PRIOR ART
Figure 2A:
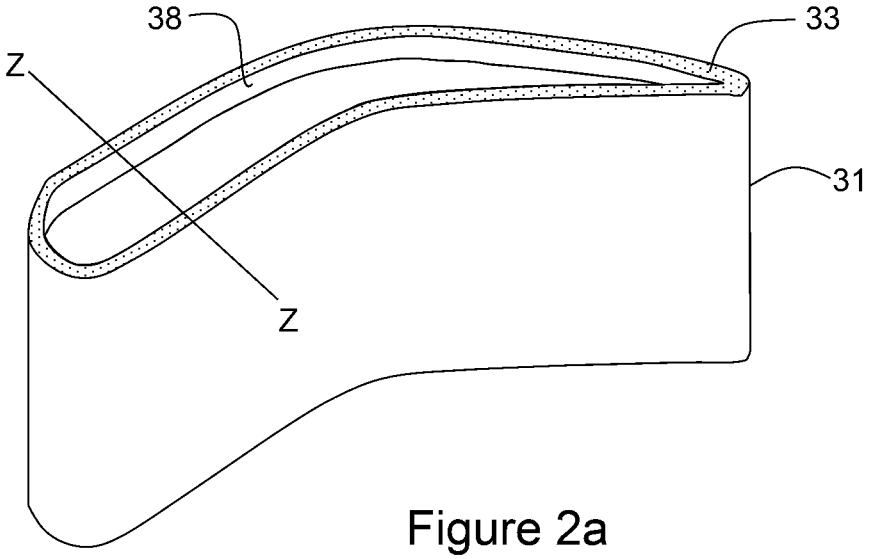
Figure 2a PRIOR ART
FIG. 2*a* shows schematically a squealer tipped turbine blade with an abrasive coating and FIG. 2*b* shows schematically a cross section on Z-Z through the blade and coating.
Figure 2B:
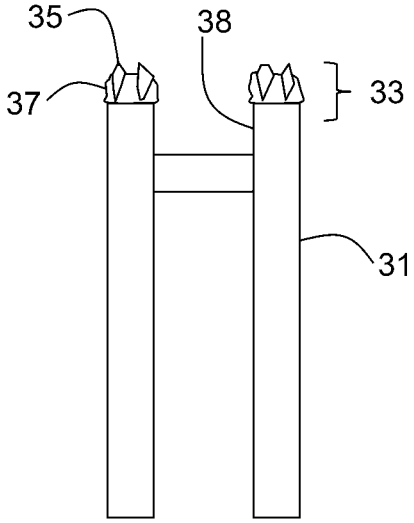
Figure 2b PRIOR ART
Figure 3:
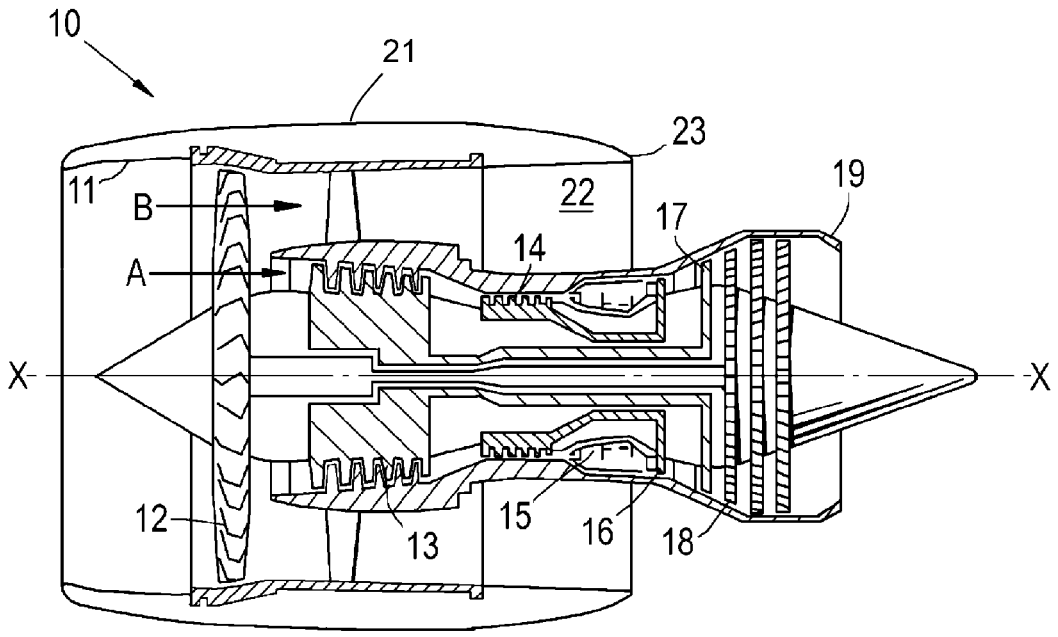
Fig. 3 PRIOR ART
FIG. 3 shows a longitudinal cross-section through a ducted fan gas turbine engine.

With reference to FIG. 3, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

Figure 4:
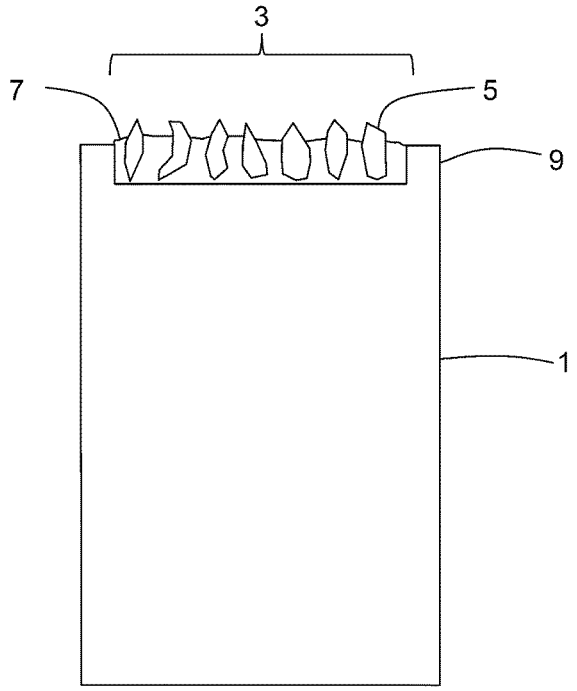
FIG. 4 shows schematically a cross section through a turbine blade with an abrasive coating according to the present invention.

The engine 10 contains turbine blades, and the tips of these blades may be coated in an abrasive coating according to the present invention, as shown in the schematic cross section through an abrasive tipped turbine blade of FIG. 4. The blade is typically made of a nickel-based superalloy, such as In718, Nimonic 75 or Nimonic 102. In cooler sections of the engine, similarly coated rotor blades may be formed of steel or a titanium-based alloy, such as Ti-6Al-4.

The turbine blade 1 has a raised rim 9 located along the outer edges of the tip of the blade. The rim bounds an inner area of the tip region on which is formed an abrasive coating 3 including hard particles 5 of cubic boron nitride embedded in a retaining matrix 7 of nickel. The raised rim has a height in a span direction of approximately 0.15 mm. Advantageously, the rim helps to anchor the coating on the tip, provides resistance to plastic deformation of the matrix, and reduces the likelihood of the abrasive coating being smeared off from the blade when in use. Also, during production, the rim corrals the particles, providing a stop and support to prevent particles being located near an outer edge of the blade tip, and either falling off or causing an unwanted build-up of retaining matrix along the outer edges. Thus, the rim can improve the aerodynamics of the coated blade and reduce any negative impact of the coating on the blade's film cooling system.

The hard particles 5 typically have a mean diameter of between 0.18 and 0.25 mm. Consequently, the raised rim has a height of between 50% and 75% of the mean diameter of the hard particles 5. In the abrasive coating 3, the hard particles 5 are located such that they project beyond the raised rim and in use, abrade a runner surface of a casing surrounding the blade. To prevent the particles falling out, they are held in place by the matrix 7, which can be applied by electroplating. For example, Praxair Surface Technologies TBT406™ electroplating process or Abrasive Technologies ATA3C™ electroplating process may be used. In such processes, an electroplated entrapment layer entraps undersides of the abrasive particles to hold them in position on the blade, and then the retaining matrix is electroplated to complete the coating. However, alternative matrix materials, such as cobalt, iron or an alloy of any one or more thereof, and alternative methods of attachment may be used. For example, the matrix could comprise NiCoCrAlY.

Figure 5:
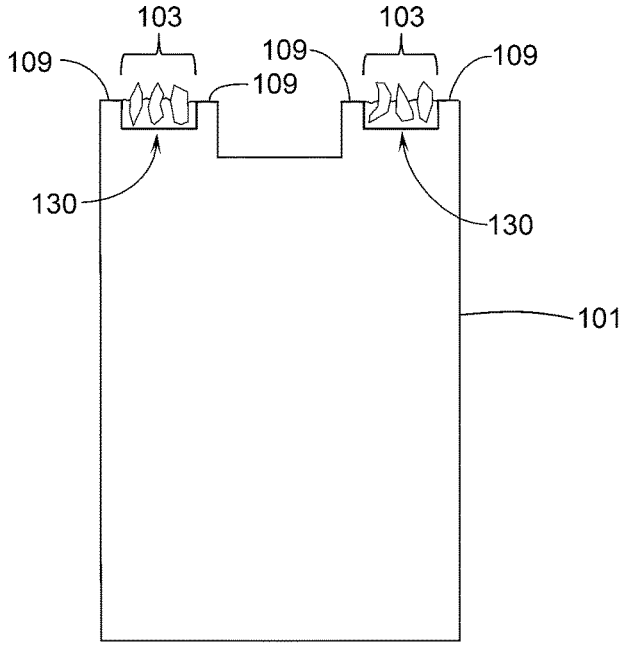
FIG. 5 shows schematically a cross section through a further turbine blade with an abrasive coating according to the present invention.

As shown in FIG. 5, in another embodiment of the present invention, a squealer tipped turbine blade 101 has the abrasive coating 103. The raised rim 109 can run along both edges of each projecting lip 130 of the squealer tip, and the abrasive coating 103 can run along the centre of each lip 130 where it is bounded on both sides by the raised rim 109.

The raised rims can be produced by casting, electro-discharge machining, milling or an additive layer manufacturing process such as laser cladding.

While the invention has been described in conjunction with the exemplary embodiments described above, many equivalent modifications and variations will be apparent to those skilled in the art when given this disclosure. Thus, the invention is not limited to turbine blade applications but may be used for other applications. For example, in a gas turbine engine context, the abrasive coating can be usefully applied to the tips of other rotor blades such as compressor blades or fan blades such that the coating abrades a runner surface of a surrounding casing. As another example, the abrasive coating may be applied to the tips of seal fins located on a gas turbine engine component, the abrasive coating thereby enhancing the ability of the fins to abrade a facing runner surface. In the case of seal fins, the fins may form part of a labyrinth seal, wherein the resistance to airflow is created by forcing the air to traverse through a series of fins. Accordingly, the exemplary embodiments of the invention set forth above are considered to be illustrative and not limiting. Various changes to the described embodiments may be made without departing from the spirit and scope of the invention.

The invention claimed is:

1. A gas turbine engine component comprising:

a unitary, single piece squealer tip rotor blade comprised of a rotor blade body, wherein the rotor blade body has a shape that includes at least one projecting lip and a raised rim, the at least one projecting lip extending from a bottom surface of a squealer pocket of the rotor blade body and the raised rim located on a top edge of the at least one projecting lip, the at least one projecting lip and the raised rim being comprised of a same material as the rotor blade, a portion of the at least one projecting lip forming a lowest top edge of the projecting lip and the raised rim extending beyond the lowest top edge of the projecting lip, and the raised rim running along both side edges of each projecting lip of the squealer tip so as to define a space bounded by the raised rim on both side edges of the projecting lip and the lowest top edge of the projecting lip, and an abrasive coating formed of hard particles embedded in a retaining matrix filling the space, the raised rim having a height from the lowest top edge of the projecting lip of between 50% and 75% of a mean diameter of the hard particles.

2. The gas turbine engine component according to claim 1, wherein the hard particles are cubic boron nitride particles.

3. The gas turbine engine component according to claim 1, wherein the retaining matrix is nickel, cobalt, iron, or an alloy of any one or more of nickel, cobalt, and iron.

4. The gas turbine engine component according to claim 1, wherein the hard particles project beyond the raised rim, such that, in use, the hard particles abrade a runner surface of an adjacent component.

5. The gas turbine engine component according to claim 1, wherein the rotor blade is made of a nickel-based superalloy, steel or titanium-based alloy.

6. The gas turbine engine component according to claim 1, wherein the retaining matrix is electroplated.

7. The gas turbine engine component according to claim 1, wherein the raised rim has a height from the lowest top edge of the projecting lip of 0.15 mm.

8. The gas turbine engine component according to claim 1, wherein the mean diameter of the hard particles is from 0.18 mm to 0.25 mm.

* * * * *